US006019139A

United States Patent [19]

Thompson, III

[11] Patent Number: 6,019,139

[45] Date of Patent: Feb. 1, 2000

[54] WEAVING REED HAVING REINFORCED DENTS

[75] Inventor: Robert G. Thompson, III, Taylors, S.C.

[73] Assignee: Stell Heddle Mfg. Co., Greenville, S.C.

[21] Appl. No.: 09/163,624

[22] Filed: Sep. 30, 1998

[51] Int. Cl.[7] ..... D03D 49/62

[52] U.S. Cl. ..... 139/192

[58] Field of Search ..... 139/192

[56] References Cited

U.S. PATENT DOCUMENTS 954,512 4/1910 Gourdeau ..... 139/192
2,860,381 11/1958 Spisak ..... 139/192
2,914,094 11/1959 Hutchins ..... 139/192
4,457,344 7/1984 Marti .
4,655,262 4/1987 Scheffel et al. .
4,989,646 2/1991 Nitta et al. .

*Primary Examiner*—Andy Falik
*Attorney, Agent, or Firm*—Dority & Manning

[57] ABSTRACT

An improved reed for weaving machines includes upper and lower channel members having an outer width and an inner channel width. A plurality of spaced apart dents have end portions held in the upper and lower channel members. Each of the dents comprises an upper leg portion adjacent to the upper channel member and a lower leg portion adjacent to the lower channel member wherein the lower leg portion has a width greater than the width of the upper leg portion.

14 Claims, 4 Drawing Sheets

WEAVING REED HAVING REINFORCED DENTS

BACKGROUND OF THE INVENTION

The present invention relates generally to reeds for high speed weaving machines, and more particularly to a reed having an improved dent profile.

Reed assemblies are well known in the art wherein the reed dents are held in relatively close fitting channels of top and bottom channel members. Typically, the reeds are held by epoxy or another strong adhesive in the channel members. With these conventional reed assemblies, the reeds have a width of generally 4 mm along the entire length of the upper and lower leg portions, including the end portions that extend into the top and bottom channels.

At the current operational speeds of modern weaving machines (approximately 800 PPM), the reed dents are subjected to high stresses and metal fatigue, particularly adjacent to the inside edges of the channel members, and particularly the bottom channel member. When the reed dents fail at these locations, the machines must be shut down and the reeds replaced. This situation results in a relatively costly and time consuming repair.

The industry is constantly seeking ways to improve weaving machinery and components thereof to eliminate downtime and costly repairs. The present invention relates to such an improvement in reed assemblies.

OBJECTS AND SUMMARY OF THE INVENTION

It is therefore a principal object of the present invention to provide an improved reed assembly.

An additional object of the present invention is to provide a reed dent profile that is capable of withstanding increased fatigue and stresses.

Additional objects and advantages of the invention will be set forth in part in the following description, or may be obvious from the description, or may be learned through practice of the invention.

In accordance with the objects and purposes of the invention, an improved reed with reinforced dents for use in weaving machines is provided, wherein the reed is conventionally held in a reed clamp of a driving slay. The reed includes upper and lower channel members, with each of the channel members having an outer width defined by front and back outer faces and an inner channel defined by front and back inner faces.

A plurality of spaced apart dents are held in the channel members. The dents have end portions with widths generally the same as the inner channel widths of the upper and lower channel members, and fit tightly within the channel members. Each of the dents comprises an upper leg portion adjacent to the upper channel member and a lower leg portion adjacent to the lower channel member. A fill yarn tunnel is defined in a front edge of the dents between the upper and lower leg portions. The lower leg portion of each of the dents has a width greater than the width of the upper leg portion.

In one particularly preferred embodiment of the invention, the upper and lower channel member front outer faces are disposed in the same plane. The dent lower leg portion back edge is disposed in a plane offset from the plane of the upper leg portion back edge. In this embodiment, the upper leg portion may have a width substantially the same as the upper channel member width. In other words, the upper leg portion has the same width as the upper end portion that extends into the upper channel member. In the embodiment wherein the front edges of the dent upper and lower leg portions extend in the same plane, the back edge of the lower leg portion may extend in the same plane as the lower channel member back outer face. In this embodiment, the dent back edge may define a "step" or lip that lies directly against the top edge of the bottom channel member.

The lip or step in the back edge of the lower leg portion of the dent may extend beyond the back outer face of the lower channel member so that the back edge of the lower leg portion extends in a plane laterally offset from the plane of the lower channel member back outer face. In this embodiment, the front edge of the lower leg member extends in the same plane as the front edge of the upper leg member.

In an alternative preferred embodiment, the dent lower and upper leg portions have a back edge disposed in a same plane, and the lower leg portion front edge is disposed in a plane laterally offset from that of the upper leg portion front edge. For example, the lower leg portion front edge may be disposed in the same plane as the lower channel member front outer face. Alternatively, the lower leg portion front edge may be disposed in a plane laterally offset from the lower channel member front outer face, and the lower and upper channel member front outer faces may be disposed in the same plane.

In an alternative preferred embodiment, the lower leg portion front and back edges are disposed in planes laterally offset from the upper leg portion front and back edges, respectively. In this embodiment, the lower leg portion front and back edges may extend in the same plane as the lower channel member front and back outer faces.

In the embodiments wherein the greater width of the lower leg portion is due to the back edge of the lower leg portion extending in a plane laterally offset from that of the upper leg portion back edge, the back edge of the dent tapers from the lower leg portion towards the upper leg portion. Preferably, the lower leg portion back edge extends substantially vertically through the area of the fill yarn tunnel in the dent and then tapers towards the upper leg portion. For instance, this taper may begin generally at the location of the upper side member defining the fill yarn tunnel.

The invention will be described in greater detail below through use of the figures.

DETAILED DESCRIPTION

Figure 1:
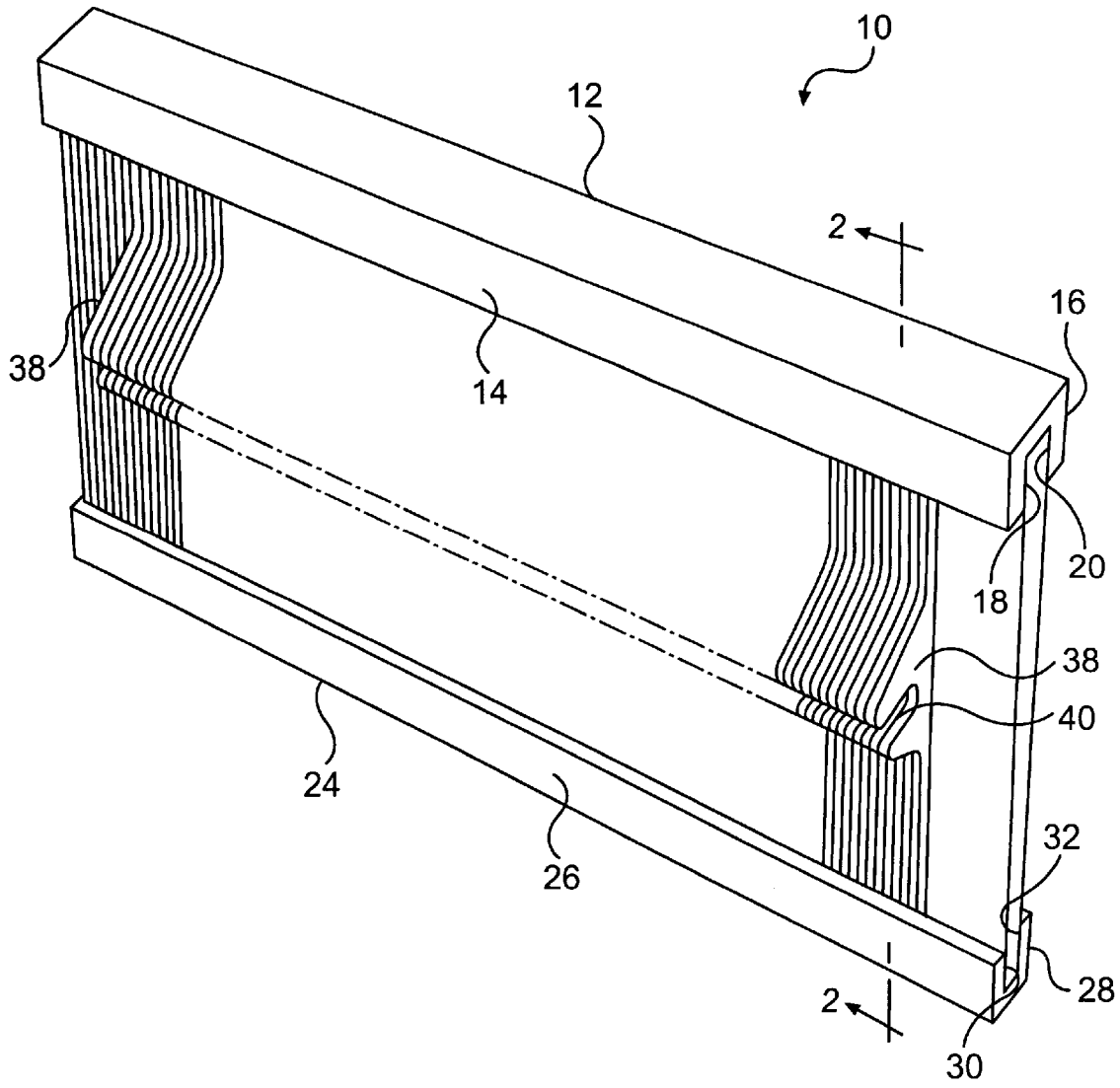
FIG. 1 is a perspective view of a reed assembly particularly illustrating the upper and lower channel members and dents.

Reference will now be made in detail to the presently preferred embodiments of the invention, one or more examples of which are illustrated in the drawings. Each example is provided by way of explanation of the invention, and is not meant as a limitation of the invention. For example, features illustrated or described as part of one embodiment can be used on another embodiment to yield still a further embodiment. It is intended that the present invention include such modifications and variations.

FIG. 1 illustrates any conventional reed assembly 10 having an upper channel member 12 and a lower channel member 24 with a plurality of adjacently disposed dents 38 held in the top and bottom channel members. As is commonly understood in the art, the upper and lower channel members 12, 24 define an inner channel in which the ends of dents 38 are fitted. Typically, the dents are held in the channels by means of epoxy, adhesives, and the like. This construction is well known by those skilled in the art and a detailed description thereof is not necessary for purposes of the present invention.

Generally, the upper channel member 12 includes a front outer face 14 and a back outer face 16. An inner channel is defined between front inner face 18 and back inner face 20. Likewise, lower channel member 24 has a front outer face 26 and a back outer face 28. The inner channel portion thereof is defined between front inner face 30 and back inner face 32.

As commonly understood in the art, the plurality of dents 38 define a fill yarn tunnel 40. Each dent 38 defines a portion of tunnel 40 between an upper and lower members side 44. Tapered front edges 46 define the entrance or front portion of fill yarn tunnel 40. This aspect of the dents is not novel to the present invention.

Figure 2:
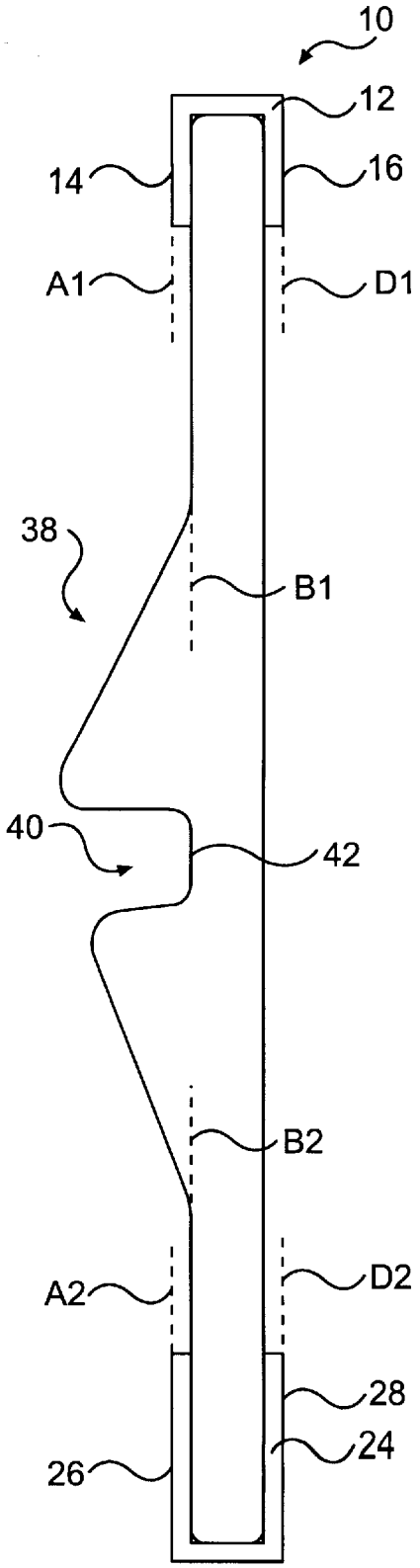
FIG. 2 PRIOR ART
FIG. 2 is a cross-cut view of the dent illustrated in FIG. 1 taken along the lines indicated and illustrates a prior art profile of the dents.

FIG. 2 illustrates the cross-sectional profile of a prior art reed, and particularly the reed dents. In this configuration, the upper and lower leg portions of the dent on each side of the fill yarn tunnel 40 have generally the same width in the vertical straight sections thereof. This width is generally the same as the inner channel width of the upper and lower channel members. As can be seen by the dashed lines in FIG. 2, the front edge of the upper and lower leg portions extend in generally the same plane and the front outer faces of the upper and lower channel members also extend in the same plane. Likewise, the back edge of the dent extends in a single plane and the back outer faces of the upper and lower channel members extend in the same plane. With this conventional configuration, the upper and lower leg portions generally have a width of 4 mm. However, this configuration has also proven to be susceptible to failure and metal fatigue in certain operational situations of modern day high speed weaving. This failure and fatigue is generally localized at the lower leg portions of the dents generally at the top of the lower channel members.

Accordingly, the present invention provides an improved dent profile to strengthen the dents at the critical lower leg portion while minimizing the mass of the dents (and thus reed) to minimize inertia forces. It is also a concern of the present invention to utilize the improved reeds with conventional slays and slay clamps. In this regard, the offset between the plane of the fill yarn impact surface 42 and the outer face 26 of the lower channel member 24 for many of the embodiments according to the invention is the same as for the prior art configuration illustrated in FIG. 2. Referring to FIG. 2, it can be seen that the plane of surface 42 is offset from the front face 26 of lower channel member 24 essentially by the thickness of the side portion of lower channel member 24. It is this relationship that should be maintained so that a consistent and repeatable position of the dents is maintained at the beat-up position of the slay regardless of whether the reed contains prior art dent profiles or dent profiles according to the present invention. Thus, the improved reeds according to the invention can be used in any conventional slay and slay clamp.

Figure 3A:
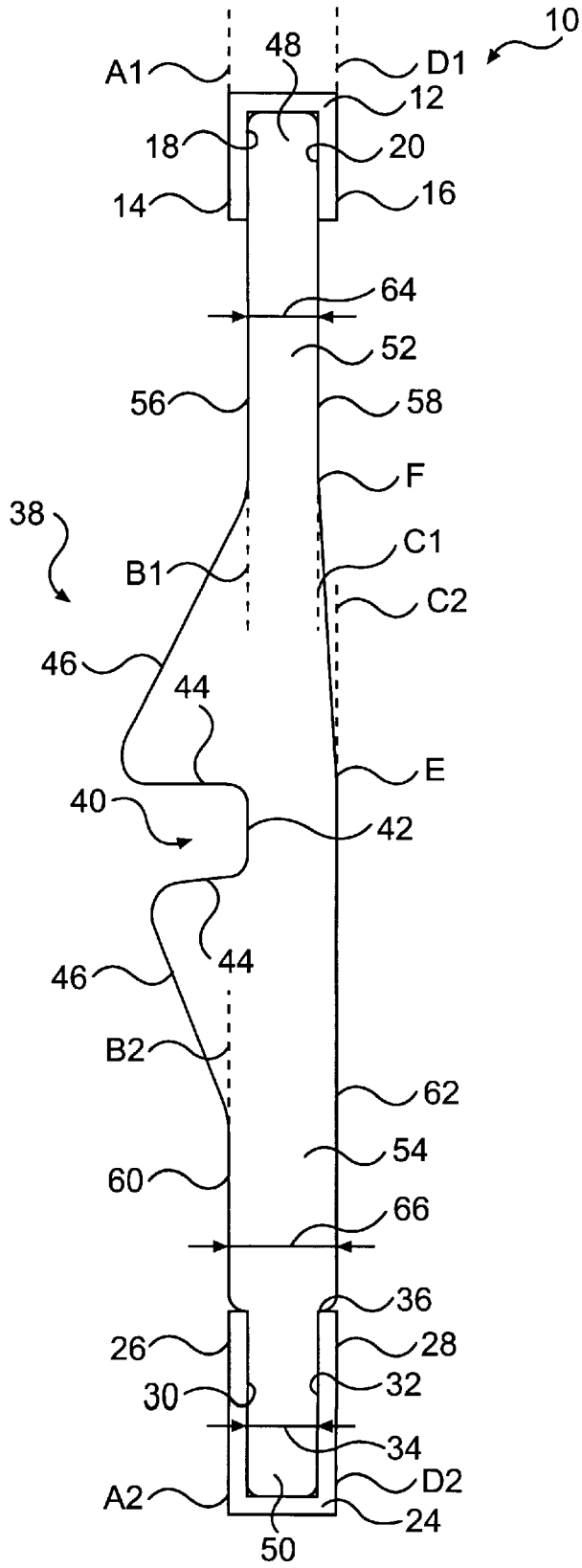
FIG. 3*a* is a cross-sectional view of the reed assembly illustrating one embodiment of a dent profile according to the invention.

One embodiment of the improved dent profile according to the invention is illustrated in FIG. 3*a*. Reed 10 includes a dent 38 having upper end 48 held in upper channel member 12 and lower end 50 held in lower channel member 24. Upper channel member 12 has an outer width defined by outer front face 14 and outer back face 16. Outer front face 14 is disposed in a vertical plane A1 and outer back face 16 is disposed in a vertical plane D1. Upper channel member 12 has an internal channel width 64 defined by front inner face 18 and back inner face 20.

Dent 38 has an upper leg portion 52 defined by essentially vertical front edge 56 and back edge 58. Upper leg portion 52 has a width 64 essentially the same as the width of upper channel member 12. Front edge 56 is disposed in an essentially vertical plane B1 and back edge 58 is disposed in plane C1. Planes A1 and B1 are offset in this embodiment essentially the thickness of the material used to form upper channel member 12. Likewise, planes C1 and D1 are offset by the same amount.

The fill yarn tunnel 40 is defined by sloped front edges 46 and side members 44. The fill yarn impact surface at the back of tunnel 40 is defined by essentially vertical member 42.

Dent 38 includes lower leg portion 54. As described above, lower leg portion 54 has a width 66 that is greater than width 64 of upper leg portion 52. Applicant has determined that, for the majority of modern day weaving applications, a lower leg portion width of 6 mm is sufficient to adequately strengthen the dent at the critical area just above lower channel member 24. However, it should be appreciated that the invention is not limited to any particular dimensions of the upper and lower leg portions.

In the embodiment illustrated in FIG. 3*a*, lower leg portion 54 includes an end 50 held within lower channel member 24. Lower channel member 24 has an inner channel width 34 defined by inner front face 30 and inner back face 32. Width 34 is essentially the same as width 64. Lower channel member 24 has an outer channel width defined by front outer face 26 and back outer face 28. In the embodiment of FIG. 3*a*, lower leg portion 54 has a front edge 60 disposed in a vertical plane B2 and a back edge 62 disposed in a vertical plane C2. Plane B2 corresponds essentially to the plane of front outer face 26, and plane C2 corresponds essentially to the plane of back outer face 28. Thus, lower leg portion 58 has a width 66 essentially the same as the outer width of lower channel member 24. In this embodiment, at the location where lower end portion 50 emerges from lower channel member 24, stepped portions of lower leg member 54 abut directly against upper edge 36 of lower leg member 24. It is preferred that the stepped portion lie directly against upper edge 36 so as to strengthen the transition from lower end portion 50 to lower leg portion 54.

Referring again to FIG. 3*a*, back edge 62 of lower leg portion 54 must merge from plane C2 to plane C1 of back edge 58 of upper leg portion 52. Applicant has determined that a particularly beneficial location to merge the back lower edge 62 into back upper edge 58 is generally at point E opposite upper side member 44 defining fill yarn tunnel 40. The back edge of dent 38 is angled or sloped from point E to point F, which is generally opposite from the location wherein the radius for sloped front edge 46 starts.

Figure 3B:
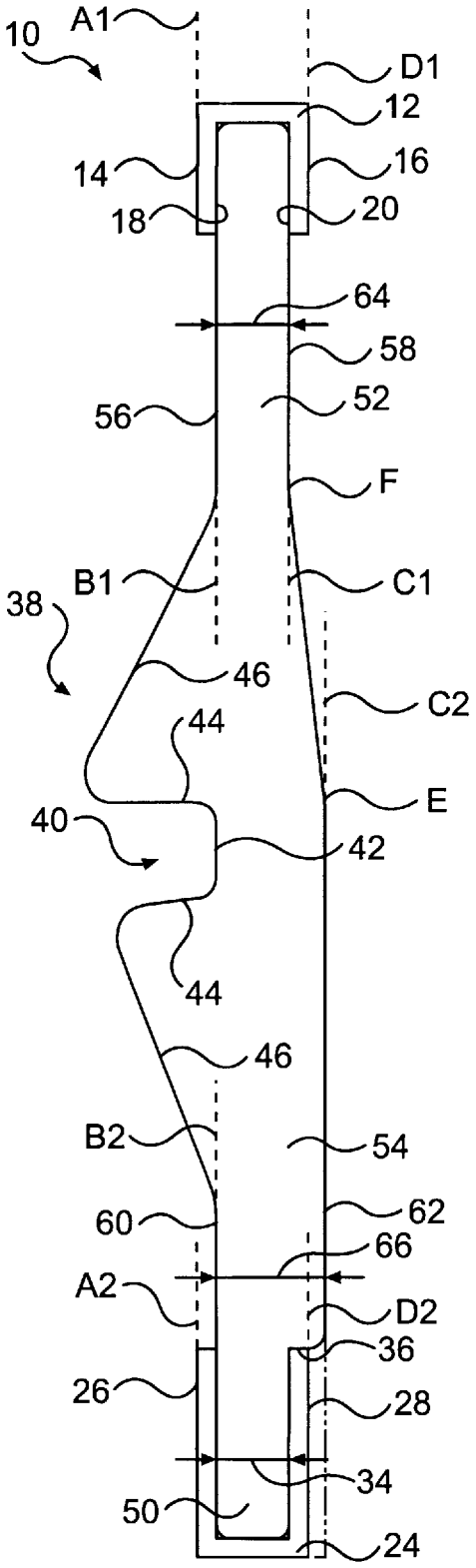
FIG. 3*b* is a cross-sectional view of the reed assembly illustrating one embodiment of a dent profile according to the invention.

An alternative preferred embodiment of the dent profile is illustrated in FIG. 3B. In this embodiment, the front edge profile of dent 38 is similar to the prior art dent illustrated in FIG. 2. Plane B2 corresponding to front edge 60 of lower leg portion 54 lies in the same plane as plane B1 corresponding to front edge 56 of upper leg portion 52. Likewise, planes A1 and A2 corresponding to the front outer faces 14, 26 of the upper and lower channel members, respectively, are also in the same plane.

In this embodiment, the increased width section 66 of lower leg portion 54 is due to the increased step in back edge 62 directly adjacent to top edge 36 of lower channel member 34. In this embodiment, back edge 62 extends in a plane C2 that is offset from plane C1 approximately twice as much as the offset illustrated in FIG. 3*a*. Plane C2 extends beyond plane D2 of outer back face 28 in the embodiment wherein lower channel member 24 is extruded from a uniform thickness material. Thus, as illustrated in solid lines in FIG. 3*b*, if it is desired to maintain or utilize the profile and shape of prior art channel members, plane D2 lies in the same plane as D1, as with the prior art configuration in FIG. 2.

In certain embodiments, it may be desired to have back edge 62 disposed in the same plane as back outer face 28 of lower channel member 24. Thus, it may be desired to form the back of channel member 24 with an increased thickness member, as illustrated in dashed lines in FIG. 3*b*. Obviously, this configuration of lower channel member 24 would need to be fabricated in a different manner. Alternatively, bottom channel member 24 may have overall increased inner and outer widths so that width 34 of lower leg end 50 is greater than the width of the upper leg end 48.

As with the discussion of FIG. 3*a*, back edge 62 merges from plane C2 to plane C1 starting approximately at point E and merging until point F. In this embodiment, the slope of the merging portion is greater than that illustrated in FIG. 3*a* since the entire increased width section of lower leg portion 54 is due to a lateral offset of back edge 62 of lower leg portion 54.

Figure 3C:
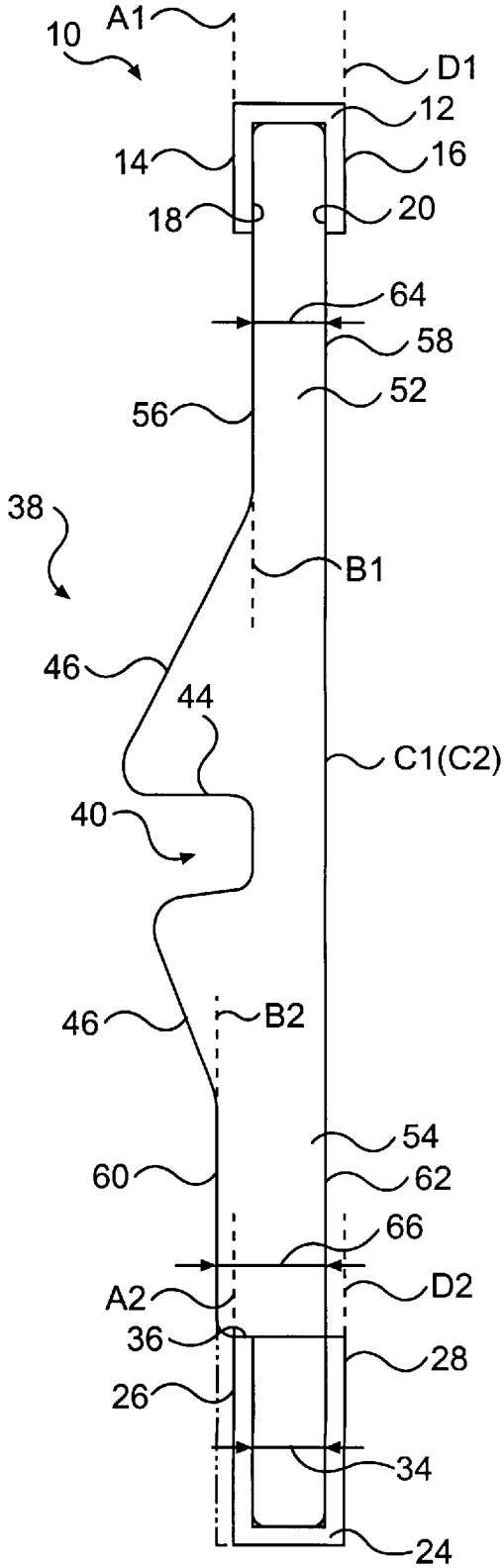
FIG. 3*c* is a cross-sectional view of the reed assembly illustrating one embodiment of a dent profile according to the invention.

FIG. 3*c* illustrates an alternative embodiment similar to FIG. 3*b* except that the increased width 66 of lower leg portion 54 is due to a lateral offset in front edge 60 of lower leg portion 54. Thus, plane B2 of front edge 60 is laterally offset from plane B1 of edge 56 of upper leg portion 52 by the amount of increased width 66 over width 64. As with the discussion of FIG. 3*b*, plane B2 of front edge 60 extends past plane A2 of front outer face 26 in the embodiment wherein the upper and lower channel members have the same width. Alternatively, as illustrated in dashed lines, lower channel member 24 may comprise an increased thickness front leg so that front outer face 26 lies in plane B2 of front edge 60. In this embodiment, back edges 58 and 62 of the upper and lower leg portions are disposed in the same plane and, in this regard, this embodiment has the back edge profile corresponding to the prior art profile illustrated in FIG. 2.

Figure 3D:
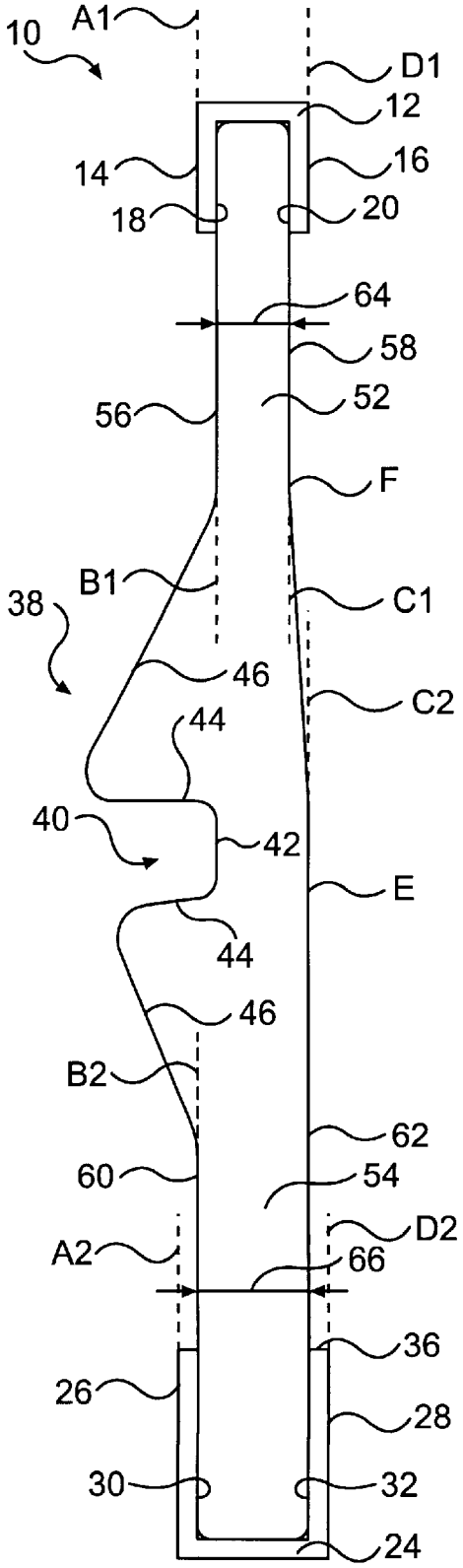
FIG. 3*d* is a cross-sectional view of the reed assembly illustrating one embodiment of a dent profile according to the invention.

Still another alternative embodiment of the dent profile according to the invention is illustrated in FIG. 3*d*. In this embodiment, lower channel member 24 has an increased inner channel width corresponding to increased width 66 of lower leg member 54. Thus, with this embodiment, the slay clamp would need to be appropriately sized to accommodate lower channel member 24. As can be seen in FIG. 3*d*, plane A2 corresponding to outer face 26 and plane D2 corresponding to outer face 28 are laterally offset from planes A1 and D1, respectively, corresponding to outer faces 14 and 16. Also, the offset between planes B2 corresponding to front edge 60 and B1 corresponding to front edge 56 is the same as the offset between planes C1 corresponding to back edge 58 and C2 corresponding to back edge 62. Back edge 62 merges to back edge 58 at point E to point F, as previously discussed.

It should be apparent to those skilled in the art that various modifications and variations can be made in the embodiments illustrated and described herein in accordance with the scope and spirit of the invention. For example, the present invention is not limited to any particular dimension or difference in widths between the upper and lower leg portions. The degree and location of the sloped portions of the back or front edges may also be widely varied. It is intended that the present invention include such modifications and variations as come within the scope of the appended claims and their equivalents.

What is claimed is:

1. An improved reed with reinforced dents for use in weaving machines wherein said reed is held in a reed clamp of a driving slay, said reed comprising:

upper and lower channel members, each of said channel members having an outer width defined by front and back outer faces and an inner channel width defined by front and back inner faces;

a plurality of spaced apart dents having end portions held in said channel members, said end portions having a width generally the same as said inner channel widths of said channel members;

each of said dents comprising an upper leg portion adjacent said upper channel member and a lower leg portion adjacent said lower channel member, and a fill yarn impact surface defined between said upper and lower leg portions;

wherein said lower leg portion has a width greater than a width of said upper leg portion; and wherein said yarn impact surface lies in a plane of said lower channel member front inner surface.

2. The reed as in claim 1, wherein said upper and lower channel member front outer faces are disposed in a same plane, and said upper leg portion of said dents has a width generally the same as said upper channel member inner channel thickness.

3. The reed as in claim 2, wherein said dent lower and upper leg portions have a back edge disposed in a same plane, and said lower leg portions have a front edge disposed in a plane offset from that of said upper leg portion front edge.

4. The reed as in claim 3, wherein said lower leg portion front edge is disposed in a plane offset from said lower channel member front outer face, said lower and upper channel member front outer faces being disposed in a same plane.

5. The reed as in claim 1, wherein said upper leg portion of said dents has a width of generally 4 mm, and said lower leg portion has a width of generally 6 mm.

6. The reed as in claim 1, wherein said dents have a back edge that tapers from said lower leg portion towards said upper leg portion.

7. An improved reed with reinforced dents for use in weaving machines wherein said reed is held in a reed clamp of a driving slay, said reed comprising:

upper and lower channel members, each of said channel members having an outer width defined by front and back outer faces and an inner channel width defined by front and back inner faces;

a plurality of spaced apart dents having end portions held in said channel members, said end portions having a width generally the same as said inner channel widths of said channel members;

each of said dents comprising an upper leg portion adjacent said upper channel member and a lower leg portion adjacent said lower channel member, said lower leg portion having a width greater than a width of said upper leg portion;

said upper and lower channel member front outer faces disposed in a same plane, and said upper leg portion of said dents having a width generally the same as said upper channel member inner channel thickness and;

wherein said dent lower and upper leg portions have a front edge disposed in a same plane, and said lower leg portions have a back edge disposed in a plane offset from that of said upper leg portion back edge.

8. The reed as in claim 7, wherein said lower leg portion back edge is disposed in a same plane as said lower channel member back outer face.

9. The reed as in claim 7, wherein said lower leg portion back edge is disposed in a plane offset from said lower channel member back outer face, said lower and upper channel member back faces being disposed in a same plane.

10. An improved reed with reinforced dents for use in weaving machines wherein said reed is held in a reed clamp of a driving slay, said reed comprising:

upper and lower channel members, each of said channel members having an outer width defined by front and back outer faces and an inner channel width defined by front and back inner faces;

a plurality of spaced apart dents having end portions held in said channel members, said end portions having a width generally the same as said inner channel widths of said channel members;

each of said dents comprising an upper leg portion adjacent said upper channel member and a lower leg portion adjacent said lower channel member, said lower leg portion having a width greater than a width of said upper leg portion;

said upper and lower channel member front outer faces disposed in a same plane, and said upper leg portion of said dents having a width generally the same as said upper channel member inner channel thickness;

said dent lower and upper leg portions having a back edge disposed in a same plane, and said lower leg portions having a front edge disposed in a plane offset from that of said upper leg portion front edge; and wherein said lower leg portion front edge is disposed in a same plane as said lower channel member front outer face.

11. An improved reed with reinforced dents for use in weaving machines wherein said reed is held in a reed clamp of a driving slay, said reed comprising:

upper and lower channel members, each of said channel members having an outer width defined by front and back outer faces and an inner channel width defined by front and back inner faces;

a plurality of spaced a part dents having end portions held in said channel members, said end portions having a width generally the same as said inner channel widths of said channel members;

each of said dents comprising an upper leg portion adjacent said upper channel member and a lower leg portion adjacent said lower channel member, said lower leg portion having a width greater than a width of said upper leg portion;

said upper and lower channel member front outer faces disposed in a same plane, and said upper leg portion of said dents having a width generally the same as said upper channel member inner channel thickness and;

wherein said lower leg portion of said dents have a front edge disposed in a plane offset from that of said upper leg portion front edge, and a back edge disposed in a plane offset from that of said upper leg portion back edge.

12. The reed as in claim 11, wherein said lower channel member back outer face is disposed in a same plane as said upper channel member back outer face, and said lower leg portion front and back edges are disposed in a same plane as said upper and lower channel front and back outer faces respectively.

13. An improved reed with reinforced dents for use in weaving machines wherein said reed is held in a reed clamp of a driving slay, said reed comprising:

upper and lower channel members, each of said channel members having an outer width defined by front and back outer faces and an inner channel width defined by front and back inner faces;

a plurality of spaced apart dents having end portions held in said channel members, said end portions having a width generally the same as said inner channel widths of said channel members;

each of said dents comprising an upper leg portion adjacent said upper channel member and a lower leg portion adjacent said lower channel member, said lower leg portion having a width greater than a width of said upper leg portion; and wherein said lower leg portion of said dents has a front edge disposed in a plane offset from that of said upper leg portion front edge, and a back edge disposed in a plane offset from that of said upper leg portion back edge, and said lower channel member front and back outer faces are disposed in planes offset from said upper channel member front and back outer faces respectively.

14. An improved reed with reinforced dents for use in weaving machines wherein said reed is held in a reed clamp of a driving slay, said reed comprising:

upper and lower channel members, each of said channel members having an outer width defined by front and back outer faces and an inner channel width defined by front and back inner faces;

a plurality of spaced apart dents having end portions held in said channel members, said end portions having a width generally the same as said inner channel widths of said channel members;

each of said dents comprising an upper leg portion adjacent said upper channel member and a lower leg portion adjacent said lower channel member, said lower leg portion having a width greater than a width of said upper leg portion;

said dents having a back edge that tapers from said lower leg portion towards said upper leg portion; and wherein dents comprise a fill yarn tunnel defined in a front edge thereof between oppositely facing upper and lower side members, said back edge extending substantially vertical from said lower leg portion past said fill yarn tunnel and tapering towards said upper leg portion generally at the position of said upper side member.

* * * * *